US007438585B2

(12) United States Patent
Morello

(10) Patent No.: US 7,438,585 B2
(45) Date of Patent: Oct. 21, 2008

(54) ELECTRICAL CONNECTOR TERMINAL HOUSING

(75) Inventor: John R. Morello, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/711,258

(22) Filed: Feb. 27, 2007

(65) Prior Publication Data

US 2007/0212950 A1 Sep. 13, 2007

Related U.S. Application Data

(60) Provisional application No. 60/779,741, filed on Mar. 7, 2006.

(51) Int. Cl.
*H01R 13/627* (2006.01)

(52) U.S. Cl. ..... 439/352

(58) Field of Classification Search ..... 439/595, 439/752, 352, 848, 353, 357, 748, 488–489, 439/744

See application file for complete search history.

(56) References Cited

U.S. PATENT DOCUMENTS

| | | | | |
|---|---|---|---|---|
| 6,354,873 | B1 * | 3/2002 | Morello et al. | 439/595 |
| 2001/0002347 | A1 * | 5/2001 | Yoshida et al. | 439/595 |
| 2004/0180576 | A1 * | 9/2004 | Hasebe | 439/595 |
| 2005/0186842 | A1 * | 8/2005 | Fukatsu et al. | 439/595 |
| 2006/0141862 | A1 * | 6/2006 | Machida et al. | 439/595 |

* cited by examiner

*Primary Examiner*—Edwin A León
(74) *Attorney, Agent, or Firm*—David P. Wood

(57) ABSTRACT

An electrical connector terminal housing adapted for carrying an electrical terminal, and including a rear wall, a front wall, and sidewalls longitudinally extending between the front and rear walls. A first transverse wall and a second transverse wall longitudinally extend at least partially between the rear and front walls. A cradle is disposed between at least one of the sidewalls and the second transverse wall and is adapted for engagement with corresponding surfaces of the electrical terminal.

10 Claims, 3 Drawing Sheets

ELECTRICAL CONNECTOR TERMINAL HOUSING

REFERENCE TO RELATED APPLICATIONS

This patent application claims priority to Provisional Patent Application No. 60/779,741 filed Mar. 7, 2006.

FIELD OF THE INVENTION

This invention relates generally to electrical connectors and, more particularly, to terminal housing of electrical connectors.

BACKGROUND OF THE INVENTION

An electrical connector typically includes a conductive terminal for terminating a wire at one end and coupling to a mating terminal at another end, and a non-conductive terminal housing carrying the terminal. The terminal housing includes laterally opposed sidewalls and vertically opposed transverse walls between the sidewalls. The sidewalls and transverse walls generally define a terminal cavity for receiving the terminal. One of the transverse walls is a rigid retention wall including a lock nib projecting into the terminal cavity, and the terminal includes a lock edge that engages the lock nib to retain the terminal in the terminal cavity. Disposed between the transverse walls, a flexible hold-down beam has a protuberance projecting into the terminal cavity for biasing the terminal against the retention wall and into engagement with the lock nib. In some applications the terminal can laterally move between and vibrate against the terminal housing sidewalls.

Such terminal-to-housing vibration causes terminal-to-terminal vibration, which leads to localized fretting of mating terminals, thereby leading to plating wear and, eventually, oxidation and concomitant failure of the terminals. Current approaches to reducing vibration use too many components, or are too bulky.

SUMMARY OF THE INVENTION

An electrical connector terminal housing is adapted for carrying an electrical terminal, and includes a rear wall, a front wall, and sidewalls longitudinally extending between the front and rear walls. The housing also includes a first transverse wall and a second transverse wall longitudinally extending at least partially between the rear and front walls. The housing further includes a cradle between at least one of the sidewalls and the second transverse wall, wherein the cradle is adapted for engagement with corresponding surfaces of the electrical terminal.

DETAILED DESCRIPTION OF THE PREFERRED EMBODIMENTS

Figure 1:
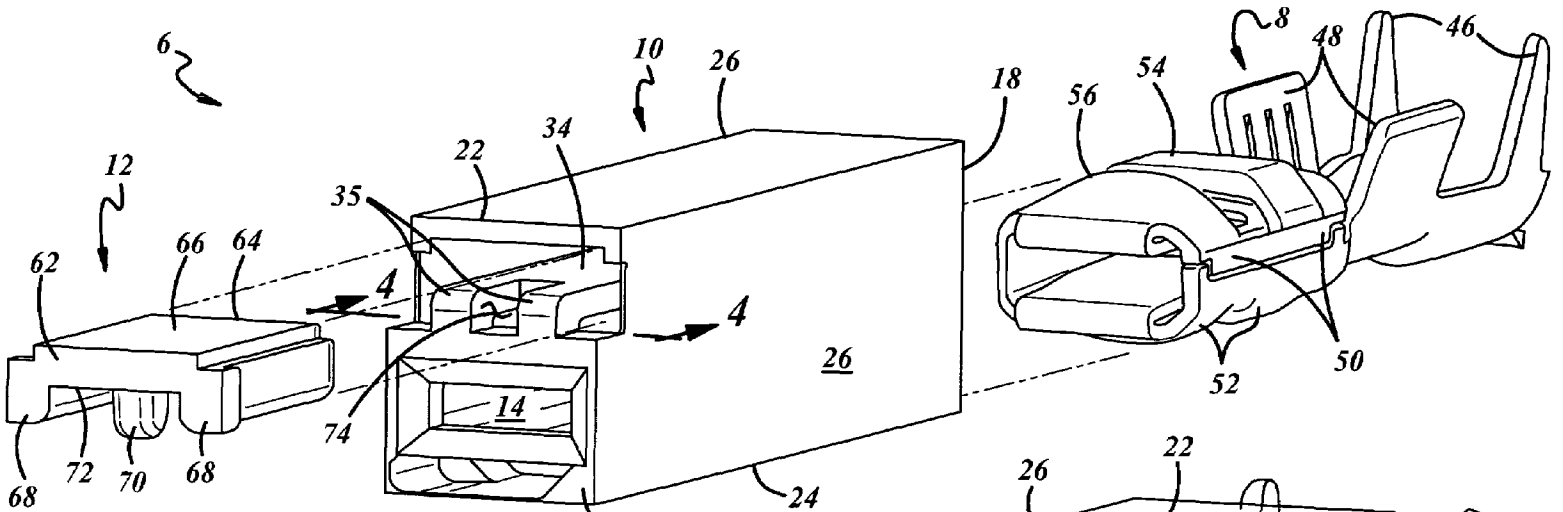
FIG. 1 is an exploded perspective view of an exemplary electrical connector assembly illustrating a terminal housing, a socket terminal, and a hold-down insert.
Figure 2:
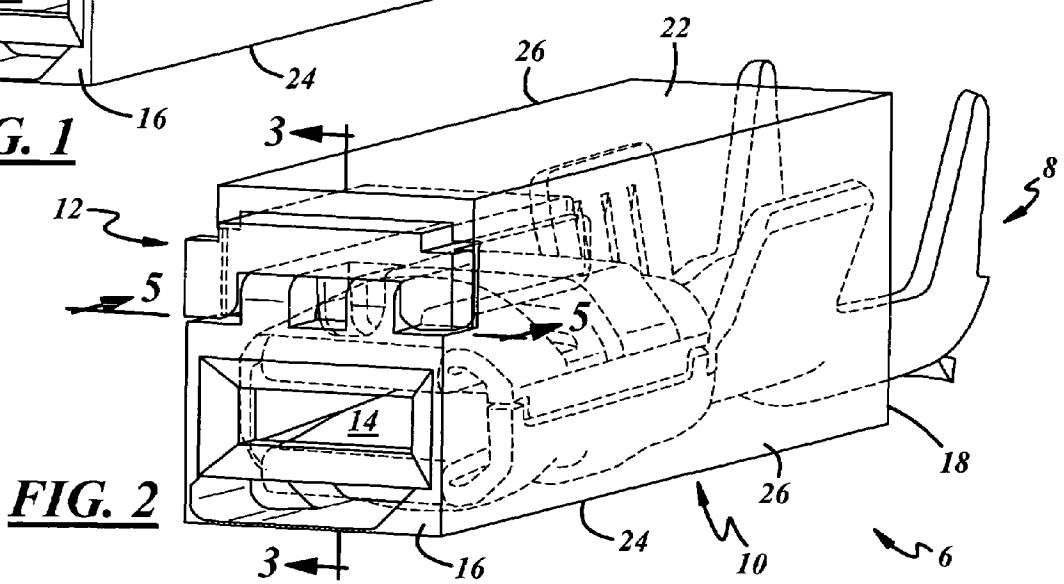
FIG. 2 is an assembled perspective view of the electrical connector assembly of FIG. 1.

Referring now to the drawings, FIGS. 1 and 2 illustrate an electrical connector assembly 6 according to an exemplary embodiment of the present invention. The connector assembly 6 includes an electrical terminal 8 for terminating an electrical element at one end and for engaging a mating terminal (not shown) at another end, a terminal housing 10 for carrying the socket terminal 8, and a wedge or hold-down insert 12 for insertion into a portion of the terminal housing 10 to provide a hold-down force to resiliently retain the terminal 8 therein.

Figure 3:
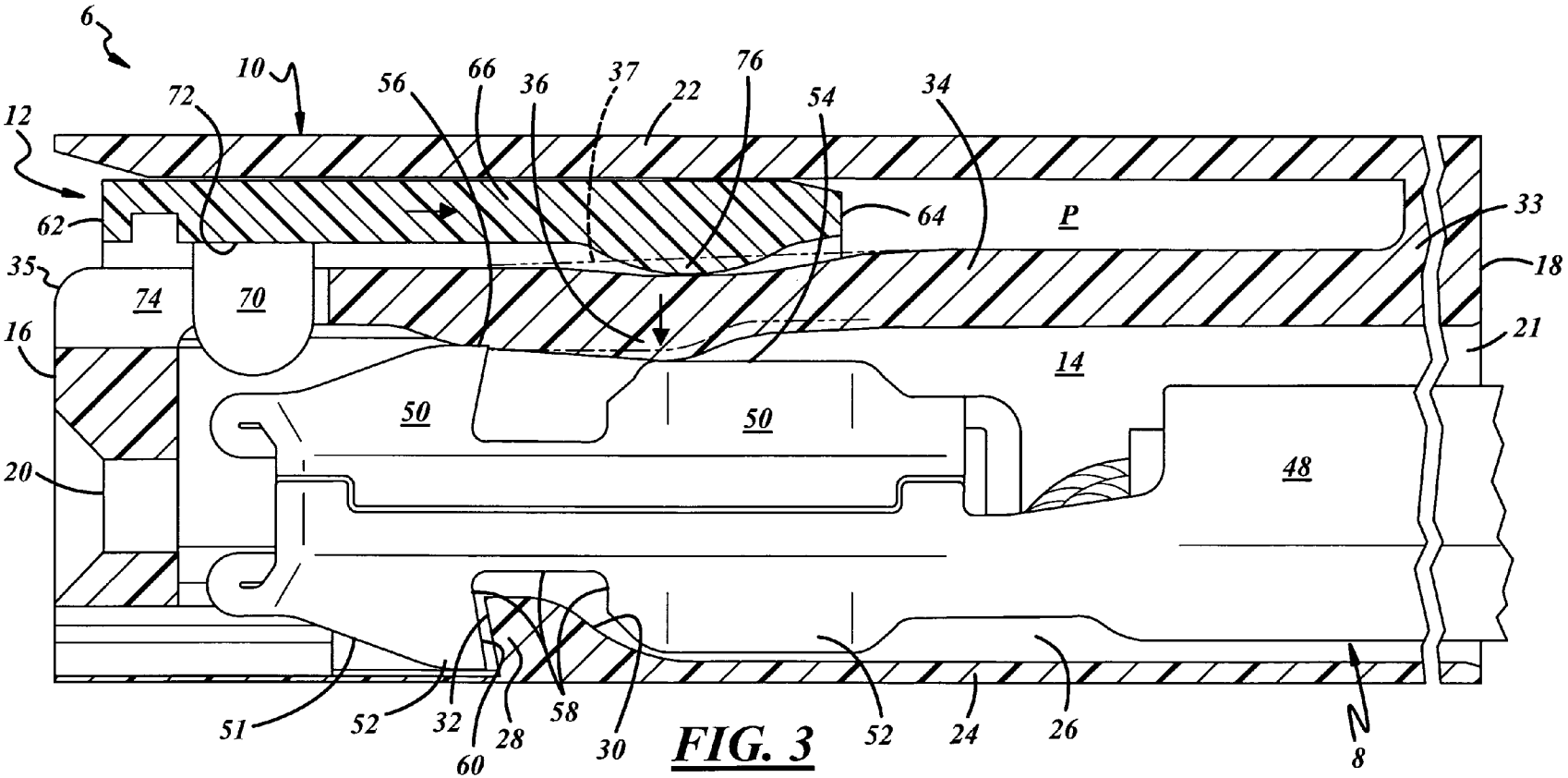
FIG. 3 is a cross-sectional view of a portion of the electrical terminal housing of FIG. 2, taken along line 3-3 thereof.

Referring now also to FIG. 3, the terminal housing 10 includes one or more terminal cavities 14 formed therein. The terminal housing 10 also includes a front wall 16 and a rear wall 18. The front wall 16 has one or more front openings 20 and the rear wall 18 has a rear opening 21, wherein the openings 20, 21 correspond with the terminal cavity 14, which extends front to rear in a longitudinal direction. The illustrated terminal cavity 14 is defined in part by relatively rigid, vertically opposed, transverse walls 22, 24 and laterally opposed sidewalls 26, and extends substantially between the front and rear walls 16, 18.

In general, the transverse walls 22, 24 are attached along their edges to other portions of the terminal housing 10 such as the sidewalls 26, front wall 16, and/or rear wall 18. More specifically, the transverse walls 22, 24 are attached along at least portions of at least two of their edges and preferably along all four of their edges to prevent movement or flexing of the transverse walls 22, 24. For example, the transverse walls 22, 24 can be end walls or partition walls of the terminal housing 10 and can longitudinally extend at least partially between the front and rear walls 16, 18. For example, the transverse walls 22, 24 extend forward from the rear wall 18 to the front wall 16, and the one transverse wall 24 is also preferably a retention wall 24 carrying a terminal retention feature 28 (FIG. 3), which extends into the terminal cavity 14. The retention feature 28 can be a relatively rigid lock nib that includes a sloped surface 30 that starts nearest the rear wall 18 of the terminal housing and terminates at a lock shoulder 32 on the retention feature 28 formed nearest the front wall 16.

A hold-down beam 34 is disposed substantially vertically opposite with respect to the rigid retention wall 24. As shown, the hold-down beam 34 is a simple beam, but could also be one or more cantilevered beams, or beams of any other suitable geometry. As will be described below, whereas the rigid retention wall 24 carries longitudinal retention forces, the hold-down beam 34 preferably acts a transverse hold-down spring for the terminal 8. A pocket P is provided between the transverse wall 22 and the hold-down beam 34 to facilitate movement or deflection of the hold-down beam 34 and insertion of the hold-down insert 12. The hold-down beam 34 is preferably attached at a first fixed end 33 to the transverse wall 22, and extends therefrom in a forward longitudinal direction to terminate in another fixed end 35 that is preferably attached to the front wall 16. One or more terminal hold-down protuberances or projections 36 may be provided on the hold-down beam 34 to extend toward the rigid retention wall 24 preferably at a location generally opposite the retention feature 28. The projection 36 may be stepped, and may be of any suitable shape, size, and contour. Also, the beam 34 includes a ramp 37 generally opposite of the projection 36 for cooperating with the hold-down insert 12 as will be described further below.

Figure 4:
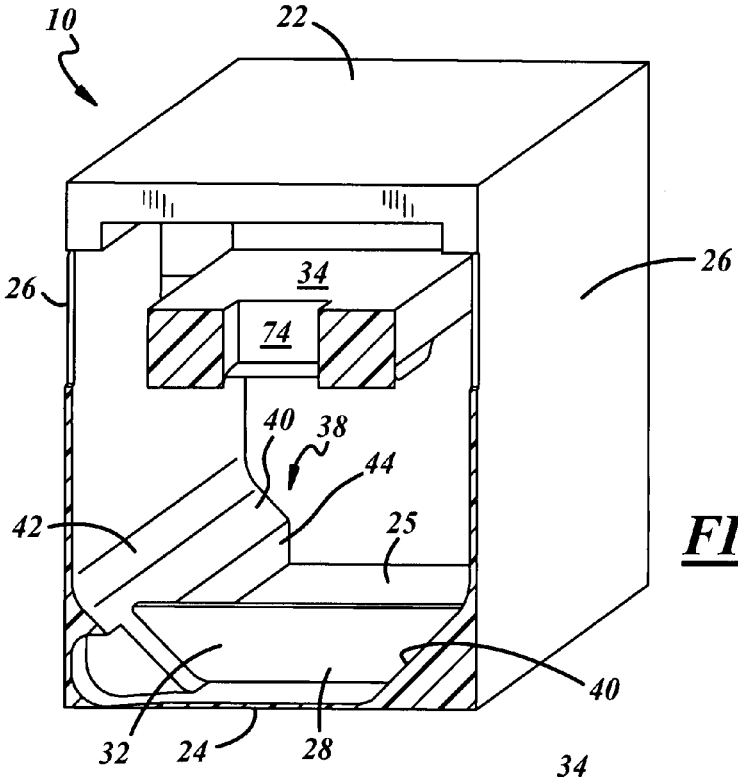
FIG. 4 is a cross-sectional view of a portion of the electrical connector assembly of FIG. 1, taken along line 4-4 thereof.
Figure 5:
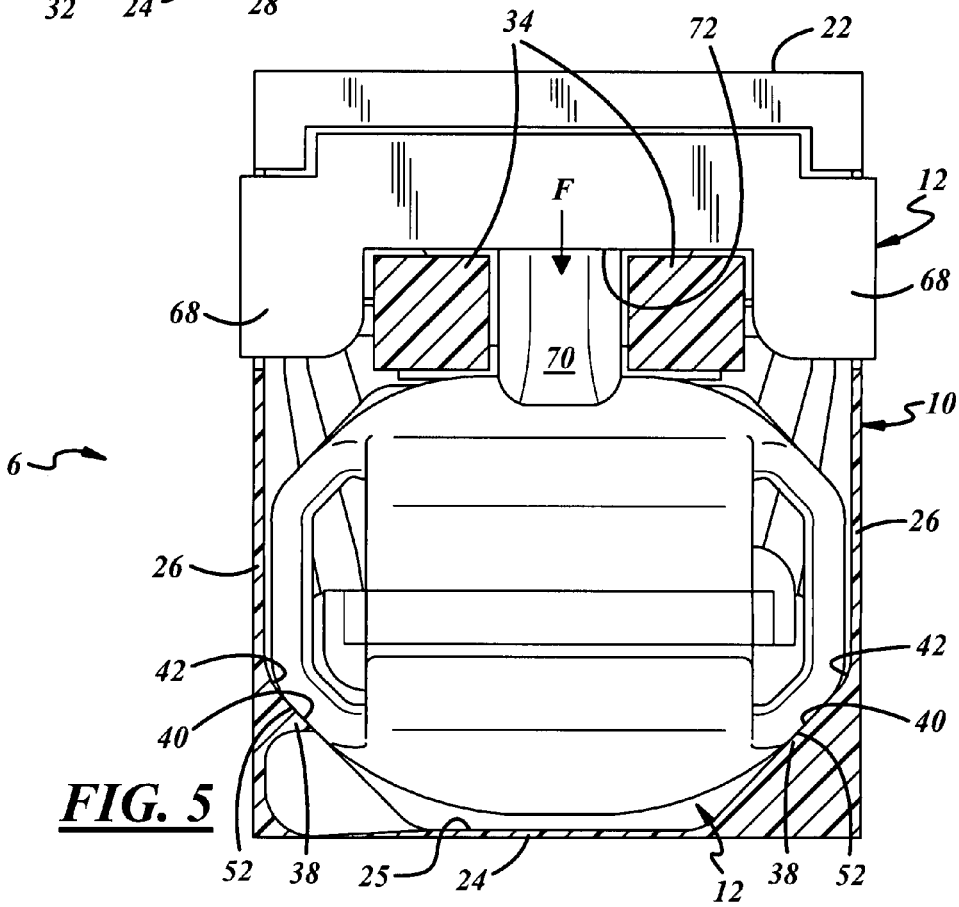
FIG. 5 is a cross-sectional view of a portion of the electrical connector assembly of FIG. 2, taken along line 5-5 thereof.

Referring to FIGS. 4 and 5, the terminal housing 10 includes features for cradling the electrical terminal 8. In a conventional connector housing, the terminal 8 would rest directly against an inside surface 25 of the retention wall 24.

But with the present invention, the terminal 8 is preferably cradled so as to be spaced above the retention wall 24. Accordingly, the terminal housing 10 is manufactured with a cradle including one or more cradling features, such as laterally opposed fillets 38, between the sidewalls 26 and the retention wall 24. The fillet 38 can be of any shape, size, and contour and, for example, can include angled wall portions that include a terminal contact surface 40 for contacting and supporting the terminal 8, a transition radius 42 between the sidewall 26 and the terminal contact surface 40, and a ledge 44 between the terminal contact surface 40 and the retention wall 24. Preferably, such fillets are used between both of the sidewalls 26 and the retention wall 24. As shown in FIG. 5, the fillets 38 are adapted for contact with corresponding surfaces of the terminal 8, as will be described below.

Referring to FIGS. 1, 3, and 5, the terminal housing 10 is constructed and arranged for receiving the electrical terminal 8 in the terminal cavity 14. The terminal housing 10 is preferably composed of any suitable electrically non-conductive material, whereas the electrical terminal 8 is composed of any suitable electrically conductive material. The electrical terminal 8 may be any suitable type of terminal and, as shown, can be a female or socket terminal. The terminal 8 may include a sheath crimp portion 46, a wire crimp portion 48, and a body portion 50. The body portion 50 can be open at its forward end, for example to receive a blade of a male or plug terminal (not shown), and the crimp portions 46, 48 are preferably constructed for attachment to an insulated wire, pin, or other electrical component (not shown). The terminal body 50 has cradle contact surfaces 52 for contacting the fillets 38 of the terminal housing 10. The cradle contact surfaces 52 are preferably rounded or angled as shown. The terminal body 50 also has a first surface 54 for contact with a portion of the hold-down beam 34 and a second surface 56 also for contact with another portion of the hold-down beam 34. Also, the terminal body 50 has a relief 58, such as a recess or an aperture, for receiving the retention feature 28, and a rigid lock edge 60 associated with the relief 58 for engaging the lock shoulder 32 of the retention feature 28.

Referring to FIGS. 1 and 3, the terminal housing 10 is also constructed and arranged for receiving the hold-down insert 12, which may be composed of any suitable material, such as the same material as the terminal housing 10. The hold-down insert 12 can be a separate component as shown, or can be a portion of another terminal housing (not otherwise shown) that is adapted to carry another terminal (not shown) and to be connected to the terminal housing 10. The hold-down insert 12 is adapted to be inserted into, and retained within, the pocket P between the wall 22 and the beam 34. Accordingly, the hold-down insert 12 preferably includes a front end 62, a rear end 64, a generally planar midsection 66 extending therebetween, and guides 68 on laterally opposed sides of the midsection 60. Toward the front end 62, a retaining feature 70 extends from an inside surface 72 of the insert midsection 66. The retaining feature 70 is adapted to be trapped within an aperture 74 in the beam 34 of the housing 10. Toward the rear end 64 of the insert 12, a projection 76 extends from the inside surface of the insert midsection 66. The beam 34 and projection 76 are adapted to urge the beam 34 into the terminal cavity 14, and the projection 76 is preferably semi-spherical in shape.

To assemble the connector assembly 6, the terminal 8 is inserted through the rear opening 21 in the rear wall 18 and into the terminal cavity 14. As best shown in FIG. 3, an angled surface 51 of the body 50 of the terminal 8 engages the retention feature 28 and the terminal 8 rides up the sloped surface 30 thereof to lift the terminal 8 generally away from the rigid retention wall 24 and toward the hold-down beam 34. As the terminal 8 rides up the sloped surface 30 of the retention feature 28, the second surface 56 of the terminal 8 engages the stepped projection 36 and the hold-down beam 34 flexes.

The hold-down beam 34 is resilient such that it tends to recover its rest position under its own inherent resilient bias force. Thus, the hold-down beam 34 flexes during terminal engagement, but imposes its inherent resilient bias force on the terminal 8 to keep the terminal 8 seated in the cavity 14. Ordinarily, the beam 34 flexes into the pocket P to accommodate further forward movement of the terminal 8 into the cavity 14 and over the retention feature 28. The terminal 8 is pushed forward until the rigid lock edge 60 snaps in front of the retention feature 28 such that the recess or aperture 58 overlies the retention feature 28.

Referring to FIG. 3, the hold-down beam 34 can apply a sufficient hold-down force to hold the terminal 8 within the cavity 14 and in engagement with the retention feature 28 of the rigid retention wall 24 and to maintain the rigid lock edge 60 against the lock shoulder 32 of the retention feature 28, thereby preventing inadvertent dislocation and rearward withdrawal of the terminal 8 from the cavity 14. In this position, the stepped projection 36 rests against the body 50 of the terminal 8, such as in line-to-line contact as shown in phantom line. If the terminal 8 moves in a direction away from the rigid retention wall 24 and toward the other transverse wall 22, the hold-down force offered by the hold-down beam 34 tends to keep the terminal 8 seated and engaged in the terminal cavity 14.

Although a simple hold-down beam 34 and standard lock feature 28 are shown, any suitable arrangement for retaining the terminal 8 within the cavity 14 can be used. For example, the housing 10 can be adapted for use with a tanged terminal, or can include a standard flex lock, flex beam, or the like.

But the hold-down insert 12 is inserted into the pocket P to force the terminal 8 into the cradle, against the fillets 38. Accordingly, the midsection 66 at its projection 76 is preferably greater in thickness than the pocket P into which the hold-down insert 12 is inserted. As the hold-down insert 12 advances, its projection 76 rides along the ramp 37 of the hold-down beam 34 and, because the hold-down beam 34 is relatively more flexible than the wall 22, the hold-down insert 12 gradually deflects the hold-down beam 34 into the cavity 14 and firmly against the terminal 8, until further advancement is restrained when the insert retaining feature 70 drops into detent in the beam aperture 74. This interference fit of the hold-down insert 12 into the pocket P imposes a hold down force on the terminal 8 sufficient to maintain the terminal 8 cradled against the terminal contact surfaces 40 of the housing 10 and thereby restricts lateral movement of the terminal 8 relative to the housing 10, at least under design intent operating conditions. While use of the insert 12 is preferred, it is contemplated that either the hold-down beam 34 itself, or the insert 12, or both can provide the hold-down force to maintain the terminal 8 cradled against the terminal contact surfaces 40 of the housing 10.

The present invention thus provides a simple and inexpensive means to laterally restrain an electrical terminal in a terminal housing of an electrical connector. The terminal is restrained therein with acceptable terminal-to-housing engagement and disengagement forces, and against lateral movement to avoid vibration between terminal and the housing. Accordingly, the electrical connector will incur relatively less localized fretting, plating wear, oxidation, and concomitant failure of terminals.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. For example, the connector assembly can include a plurality of terminals and inserts, and the connector housing can correspondingly be provided with a plurality of terminal cavities and other features to accommodate the terminals and inserts. Moreover, directional words such as front, rear, top, bottom, upper, lower, radial, circumferential, axial, lateral, longitudinal, vertical, horizontal, transverse, and the like are employed by way of description and not limitation. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

I claim:

1. An electrical connector terminal housing adapted for carrying an electrical terminal comprising:

a rear wall;

a front wall;

sidewalls longitudinally extending between the front and rear walls;

a first transverse wall and a second transverse wall longitudinally extending at least partially between the rear and front walls;

a cradle between at least one of the sidewalls and the second transverse wall adapted for engagement with corresponding surfaces of the electrical terminal to space the terminal above the second traverse wall and laterally restrain the electrical terminal in the terminal housing;

at least one hold-down beam between the first and second transverse walls and being adapted to engage the electrical terminal, wherein the at least one hold-down beam includes a ramp surface opposed to the first transverse wall; and a pocket defined between the first transverse wall and the hold-down beam and being adapted to accept an insert therein, wherein the insert is adapted to cooperate with the ramp surface to urge the hold-down beam against the terminal to restrain lateral movement of the terminal so as to reduce terminal-to-housing vibration;

wherein the hold-down beam includes an aperture therein and the insert includes a retention feature for cooperating with aperture to retain the insert in the pocket.

2. An electrical connector terminal housing adapted for carrying an electrical terminal, comprising:

a rear wall;

a front wall;

sidewalls longitudinally extending between the front and rear walls;

a first transverse wall and a second transverse wall longitudinally extending at least partially between the rear and front walls;

a cradle that includes laterally opposed fillets between the sidewalls and the second transverse wall that are constructed and arranged to space the electrical terminal above the second traverse wall and laterally restrain the electrical terminal in the terminal housing;

at least one hold-down beam between the first and second transverse walls and being adapted to engage the electrical terminal, wherein the at least one hold-down beam includes a ramp surface opposed to the first transverse wall; and a pocket defined between the first transverse wall and the hold-down beam and being adapted to accept an insert therein, wherein the insert is adapted to cooperate with the ramp surface to urge the hold-down beam against the terminal to restrain lateral movement of the terminal so as to reduce terminal-to-housing vibration;

wherein the hold-down beam includes an aperture therein and the insert includes a retention feature for cooperating with aperture to retain the insert in the pocket.

3. The electrical connector terminal housing of claim 2, wherein the fillets longitudinally extend substantially between the front and rear walls.

4. The electrical connector terminal housing of claim 2, wherein the fillets include angled terminal contact surfaces adapted for contact with corresponding surfaces of the terminal.

5. The electrical connector terminal housing of claim 4, wherein the fillets further include transition radii between the sidewalls and the terminal contact surfaces and ledges between the terminal contact surfaces and the second transverse wall.

6. An electrical connector, comprising:

a terminal for terminating an electrical element and for releasably coupling to a mating terminal, and including cradle contact surfaces;

a terminal housing for carrying the terminal, and comprising:

a rear wall;

a front wall;

sidewalls longitudinally extending between the front and rear walls;

a first transverse wall;

a second transverse wall opposed from the first transverse wall and longitudinally extending at least partially between the rear and front walls and including a terminal retention feature adapted for retention of the electrical terminal;

a terminal cavity carrying the terminal therein and longitudinally extending substantially between the front and rear walls and being at least partially defined by the sidewalls;

a cradle between the sidewalls and the second transverse wall engaging the cradle contact surfaces of the electrical terminal to space the electrical terminal above the second transverse wall;

at least one hold-down beam between the first and second transverse walls and including a first surface engaging the electrical terminal, and a ramp surface; and a pocket defined between the at least one hold-down beam and the first transverse wall; and an insert disposed in the pocket and cooperating with the ramp surface to urge the hold-down beam against the terminal to force the terminal against the cradle to space the terminal above the second transverse wall and to restrain lateral movement of the terminal so as to reduce terminal-to-housing vibration.

7. The electrical connector terminal housing of claim 6, wherein the hold-down beam includes an aperture therein and the insert includes a retention feature for cooperating with aperture to retain the insert in the pocket.

8. The electrical connector terminal housing of claim 6, wherein laterally opposed fillets between the sidewalls and the second transverse wall.

9. The electrical connector terminal housing of claim 8, wherein the fillets include terminal contact surfaces adapted for contact with corresponding surfaces of the terminal, and further include transition radii between the sidewalls and the terminal contact surfaces and ledges between the terminal contact surfaces and the second transverse wall.

10. The electrical connector terminal housing of claim 8, wherein the fillets extend substantially between the front and rear walls.

* * * * *